United States Patent [19]

Reeves et al.

[11] 4,413,242

[45] Nov. 1, 1983

[54] HYBRID TEE WAVEGUIDE ASSEMBLY

[75] Inventors: Albert H. Reeves, Linden; Joseph S. Michalski, Morris Township, Morris County, both of N.J.

[73] Assignee: Litton Systems, Inc., Morris Plains, N.J.

[21] Appl. No.: 298,225

[22] Filed: Aug. 31, 1981

[51] Int. Cl.[3] ..... H01P 5/20

[52] U.S. Cl. ..... 333/122; 333/125

[58] Field of Search ..... 333/122, 125

[56] References Cited

U.S. PATENT DOCUMENTS 3,375,472 3/1968 Walker ..... 333/122

OTHER PUBLICATIONS

Howe, Jr., *Stripline Circuit Design,* Artech House, 1974, pp. 33, 34, TK7876H6.

Moreno, *Microwave Transmission Design Data,* Dover Publ. N.Y., 1948, pp. 66, 67.

*Primary Examiner*—Paul L. Gensler

*Attorney, Agent, or Firm*—Michael H. Wallach; Robert F. Rotella

[57] ABSTRACT

An improved magic tee constructed to maximize the power that can be transferred from the H-plane arm to the collinear side arms and vice versa. The matching post is designed to maximize the breakdown voltage between the post tip and the walls of the E-plane arm. This is accomplished by selecting the post diameter to produce a ratio of the E-plane arm height to post diameter which develops a characteristic impedance corresponding to that of a coaxial transmission line constructed to withstand the maximum breakdown voltage between the transmission line center conductor and conductive shielding for a given shield separation.

9 Claims, 4 Drawing Figures

HYBRID TEE WAVEGUIDE ASSEMBLY

BACKGROUND OF INVENTION

The invention is in the field of hybrid junctions and specifically relates to four port junctions known as magic tees.

A common type of waveguide hybrid junction known as the magic tee is a four port microwave device comprised of electrically coupled waveguide sections physically disposed about a plane of symmetry through one of the sections. That is, a first section termed the H-plane arm and two additional sections, termed the two collinear side arms, are joined to form an H-plane junction between the H-plane arm and the two collinear arms. These three sections are disposed in the shape of a tee. A fourth section, termed the E-plane arm is joined to the tee forming an E-plane junction between the H-plane arm and the E-plane arm. The collinear side arms and the E-plane arm are also located, relative to each other, in the shape of a tee.

When properly designed, the hybrid junction just described is electrically symmetrical and appears to possess what has been called magical properties; thus, the name magic tee. These properties include equal power division into the two collinear side arms (provided they are terminated in matched loads) when power is applied to either the H-plane arm or the E-plane arm. Significantly, with matched loads in the collinear side arms there is no coupling between the E-plane arm and the H-plane arm. Thus, when the signal is applied to the H-plane arm no signal appears in the E-plane arm and vice versa.

When the input signal is fed to the H-plane arm the electric field in the two collinear arms are in phase at points equal distances from the center of the junction. As a result, the vector sum of signals applied to the two collinear arms is produced in the H-plane arm. Because of this property, the H-plane arm is considered as being connected in shunt or parallel with the collinear side arms. If power is supplied to the E-plane arm, the electric field in the two collinear arms will be 180° out of phase at points equal distances from the center of the junction. The vector difference of the signals applied to the two collinear arms is seen in the E-plane arm. The E-plane arm is, therefore, viewed as the series arm, meaning that the E-plane arm appears to be connected in series with the two collinear arms.

The impedance looking into the H-plane and the E-plane arms with properly matched loads in the two collinear side arms is not matched to the input waveguides. If, by addition of matching structures, these impedances are made to match the input waveguides the device will possess the additional quality of balance and reflection of an input signal to either the H-plane arm or E-plane arm will be minimized. Matching of the H-plane arm and the E-plane arm is conventionally accomplished by the addition of matching structures such as metal diaphragms. However, as the voltage standing wave ratio that must be matched is generally high, the bandwidth is small. To improve bandwidth it is known to place the matching structures at the heart of the junction. A typical matching structure for matching the impedance looking into the H-plane arm to the input waveguide involves centrally locating a metallic post in the junction. The optimum length and position of this post is determined experimentally. In the past there was little concern with post diameter. The post diameter affects the maximum power which can be handled by the magic tee. The maximum power capability is directly related to the breakdown voltage between the post and the walls of the waveguide section forming the E-plane arm. The breakdown voltage is the maximum voltage which can be tolerated before arcing occurs across the gap between the post and E-plane arm walls. It was believed that the breakdown voltage increased in direct proportion to the gap size. That is, it was thought that to increase breakdown voltage and thus the power handling capacity of the junction, one need only reduce the post diameter, thereby increasing the space or gap between the walls of the E-plane arm and the post. However, even with relatively thin posts, the magic tee remained a low power device for arcing between the tip of the post and the walls of the E-plane arm limited the power that could be applied to the junction.

SUMMARY OF THE INVENTION

It is an object of the invention to provide a technique for determining the optimum post diameter for maximum power transfer in a magic tee.

It is a further object to produce magic tee hybrid junctions with matching posts determined according to the technique of the present invention.

A still further object is to produce a matching post for a magic tee, said matching post being produced with optimum post diameter determined by the teachings of the invention, and constructed such that regardless of the need to vary the post length, the distance between the top of the post and a reference point on the E-plane arm is fixed.

The objects of the invention are accomplished by selecting the diameter of the matching post of a magic tee such that it is in a predetermined mathematical relation with the height of the E-plane arm. Using conventional waveguide nomenclature, the waveguide height refers to the shorter of the two dimensions defining the cross section of a rectangular waveguide. For example, one form of an S band rectangular waveguide has a cross section defined by a height of 0.670 inches and a width of 2.840 inches.

We have determined that the power handling capacity of a magic tee can be maximized if the matching post and E-plane arm are designed according to criteria for maximum breakdown voltage in a coaxial transmission line. More specifically, power into the H-plane arm can be maximized relative to the breakdown voltage between the matching post and the E-plane arm by selecting the post diameter such that the ratio of the E-plane waveguide height to the post diameter provides a characteristic impedance equal to the characteristic impedance of a coaxial transmission line constructed to withstand the maximum breakdown voltage between the shield and center conductor. With post diameter determined according to the teachings of the invention, post length is then selected experimently. It was found that as the post diameter was increased, the length of the post had to be made longer to achieve proper matching of the H-plane arm to the input waveguide. However, design criteria for magic tees often provide constraints on the maximum allowable post length. We determined that post length could be varied while maintaining the distance between the post tip and a reference point on the E-plane arm constant by extending the post from a button made of the same material as the post and forming a well in the button into which the post is situated.

Post length is varied by changing the well depth, instead of extending the post tip. Thus, the distance between the post tip and the reference point is kept constant.

DETAILED DESCRIPTION

Figure 1:
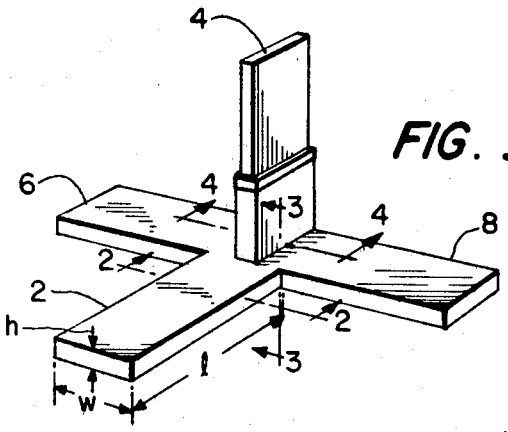
FIG. 1 is a perspective view of a magic tee hybrid junction.
Figure 2:
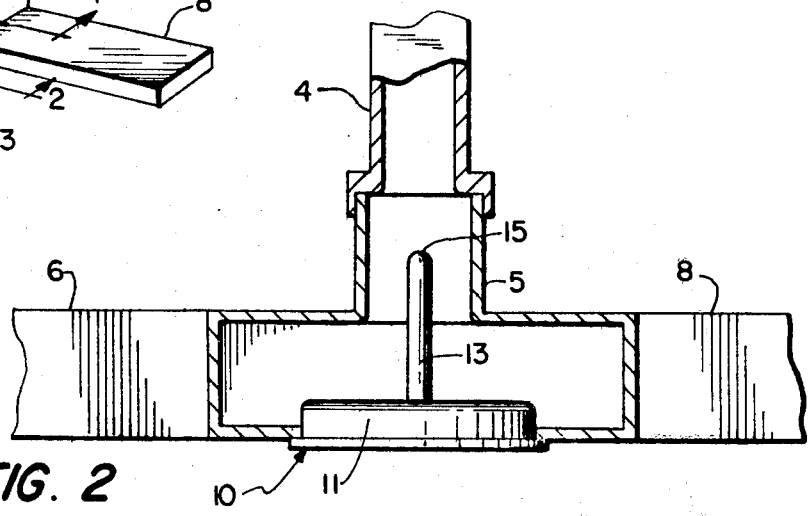
FIG. 2 is a cross sectional view of the device of FIG. 1 taken across line 2—2 of FIG. 1.
Figure 3:
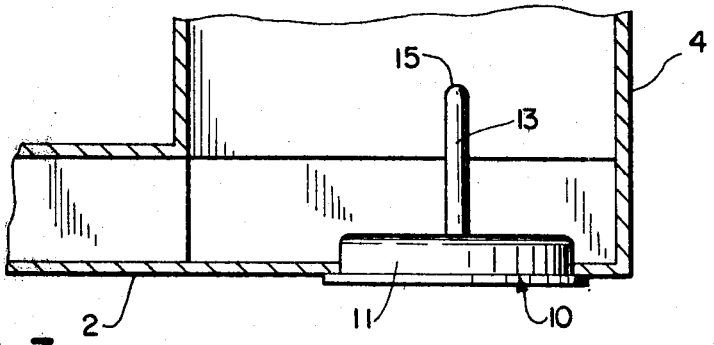
FIG. 3 is a cross sectional view of the device of FIG. 1 taken across line 3—3 of FIG. 1.

Referring to the drawings, FIG. 1 shows a waveguide magic tee which is comprised of four waveguide segments producing a four port device. Each waveguide segment has a height, h, a width, w, and a length, l. The H-plane arm 2 forms a first waveguide section attached to two collinear side arms 6 and 8. The E-plane arm 4 forms the fourth waveguide section of the magic tee. In the illustrated embodiment of the invention, the E-plane arm is shown with a step 14. Such steps are used to adapt the section output to the input of a waveguide section to which the tee may be connected. For example, the magic tee may be constructed of waveguide sections having a height of 0.670 inches and width of 2.840. If the E-plane arm has to be coupled to a section with a height of 0.400 inches, a step arrangement as shown at 14 is used to transform the E-plane arm from a 0.670 high waveguide to one only 0.400 inches high. This arrangement is for illustration purposes only and the invention is equally applicable to other magic tee structures which do not include a step in the E-plane arm.

The impedance looking into the H-plane arm has been matched to the input waveguide (not shown) by the addition of a metallic button post shown generally at 10 located at the junction. The optimum length and location of this post in the junction is determined experimentally. This post 10 is a limiting factor in the power handling capacity of the magic tee. As the power input to the H-plane arm increases, so does the voltage gradient (i.e., the electric field intensity) between the post tip 15 and the walls 5 of the E-plane arm. When this voltage reaches a breakdown point, arcing occurs between the post and walls 5. Such arcing cannot be tolerated in the junction and thus defines the maximum power handling capacity of the magic tee when the input signal is applied to the H-plane arm.

In designing a magic tee, it has been usual practice to choose a standard post diameter and attempt to minimize the post diameter to provide a maximum gap length between the post 13 and walls 5, while varying the length and position of the post to obtain a good match looking into the H-plane arm. A radius is provided at the end of the post to improve the power handling capability.

According to the teachings of the present invention, the post diameter of a magic tee is not minimized in an effort to maximize the power handling capabilities of the device. We discovered that with the power being supplied to the hybrid junction at the input to the H-plane arm, the breakdown voltage between the post 13 and walls 5 is maximized if the post diameter is selected such that the ratio of the waveguide height, h of the E-plane arm, to the post diameter produces a characteristic impedance equal to the characteristic impedance which gives a coaxial transmission line maximum breakdown voltage between the center conductor and the conductive shield of the transmission line. The impedance corresponds to a characteristic impedance of approximately 60 ohms. Increasing the breakdown voltage allows a larger amount of power to be handled by the device. In a coaxial line the limiting voltage gradient before breakdown occurs in an air filled line is approximately 30,000 volts per centimeter.

As noted by Harlan Howe, Jr., in his publiction *Stripline Circuit Design,* Artech House, Inc., 1979 Ed at page 33; there are many recognized techniques for accurately determining characteristic impedance of a transmission line with the Cohn equation being the most widely used method of calculation. The Cohn equation is written as follows:

$$Z_o = \frac{138}{\sqrt{\epsilon_r}} \log_{10} \frac{4h}{\pi D} \quad (1)$$

where:

$Z_o$=characteristic impedance.

$\epsilon_r$=dielectric constant of the material occupying the space between the center conductor and conductive shield ($\epsilon_r$=1 for an air dielectric).

h=waveguide height.

D=diameter of the matching post.

Thus, the characteristic impedance is a function of the ratio h/D. With respect to coaxial transmission lines, it is known that an optimum ratio h/D exists at which breakdown voltage is a maximum. This optimum ratio corresponds to a charcteristic impedance of approximately 60 ohms for the coaxial transmission line with an air filled gap. Applying the teaching of the present invention to an E-plane arm having a height 0.670 inches, and H-plane arm matching post has a diameter of 0.300 inches. This diameter is substantially greater than that conventionally used in magic tees comprised of waveguide sections having a height of 0.670 inches and width of 2.840 inches.

By way of example and without limiting the teachings of the present invention, a magic tee was constructed according to the teachings of the invention. The hybrid junction device was comprised of four waveguide sections shown in FIG. 1 at 2, 4, 6, 8, each having a height of 0.670 inches and width of 2.840 inches. A matching button post 10 was located in the junction. Button posts, per se, are known in the art. In the magic tee constructed, the E-plane arm was provided with a step transformer 14 to transform the 0.670 inch high E-plane arm waveguide to a 0.400 inch high waveguide. A power source, not shown, was connected to the H-plane arm 2 and power thereby supplied to the collinear side arms 6, 8 which were impedance matched. The length of post 13 was conventionally determined to effect matching of the H-plane arm 2. The diameter of post 13 was selected at 0.300 inches pursuant to the teachings of this invention. No arcing occured across the gap defined by the post 13 and walls 5. When the 0.300 inch post was replaced with a 0.150 inch diameter post, a diameter selected according to the technique of the prior art and corresponding to a characteristic impedance of 104 ohms, arcing occurred at an even lower power level accomodated by the 0.300 inch diameter post. The structure was then tested with other diameter posts corresponding to characteristic impedances between 104 ohms and 63 ohms as follows:

TABLE 1

| Post Diameter | Characteristic Impedance of Transmission line Determined by Cohn Equation |
|---|---|
| .150 | 104 ohms |
| .200 | 87 ohms |
| .250 | 73 ohms |
| .300 | 63 ohms |

It was determined that the power handling capacity of the magic tee increased as the post diameter approached the 0.300 inch size which substantially corresponds to the characteristic impedance of a coaxial transmission designed for maximum breakdown voltage.

Figure 4:
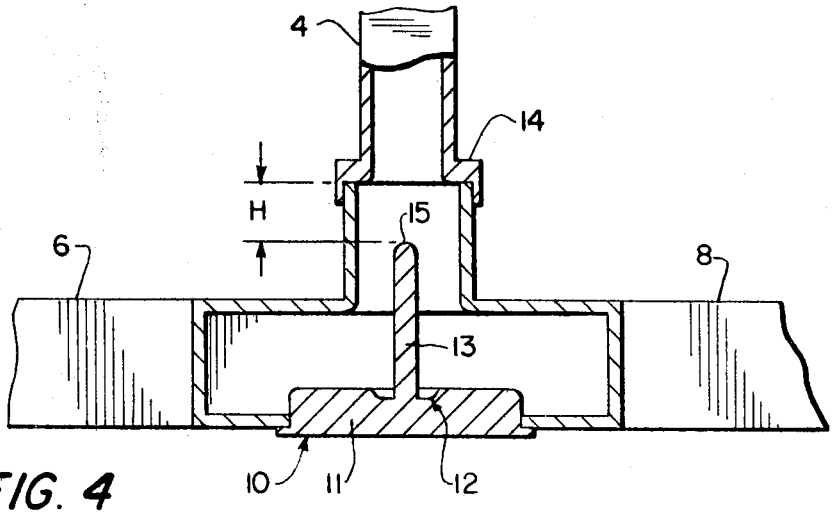
FIG. 4 is a cross sectional view of the device of FIG. 1 taken across line 4—4 of FIG. 1.

To accomplish matching, the post height in the example herein described increased as the post diameter was increased. A well 12 which encircles the post 13 was formed in the button 11 of button post 10 to maintain the post tip 15 at the same position within the 0.670 spacing between walls 5 as the height of post 13 was increased. As best seen in FIG. 4, the height of post 13 can be varied while maintaining the distance H constant by varying the depth of well 12.

In summary, power handling capabilities of magic tee hybrid junctions having input power supplied to the H-plane arm can be greatly enhanced, indeed maximized, by selecting the diameter of the matching post such that the ratio of the E-plane arm waveguide height to the post diameter defines a characteristic impedance which provides for maximum breakdown voltage in coaxial transmission line. Where it is necessary to limit post length within the E-plane arm (the length generally having to be increased to maintain matching as post diameter increases) the post length is effectively increased by creating a well in the button from which the post extends.

While a specific embodiment of the invention has been disclosed for illustration purposes, said illustrative embodiment is not intended to limit the scope of the invention as set forth in the appended claims. It should be apparent to those skilled in the art that numerous other embodiments of the invention fall within the scope of the claims. For example, while the Cohn equations have been shown to be applicable to a cylindrical post, it would be apparent to one skilled in the art in light of the teachings of this invention to apply a modified version of the Cohn equation to post geometries when cross-sections are not circular, as for example to oval sections. Without limitation, such other embodiments include magic tees constructed of waveguides having dimensions other than those specified, magic tees without step transformers and other hybrid junctions with matching posts situated in a waveguide cavity. It is intended that the invention be limited only by the claims.

What is claimed is:

1. A hybrid junction having enhanced power handling capacity, said hybrid junction having an H-plane arm, an E-plane arm and two collinear side arms formed of waveguide sections, said power being suppliable to said hybrid junction at the input of the H-plane arm, said hybrid junction including an H-plane arm matching post located in the junction formed by the intersection of the E-plane arm, the H-plane arm and the two collinear side arms and extending into the E-plane arm said E-plane arm having a known height, said matching post having a diameter such that the ratio of the E-plane arm height to the post diameter would yield a characteristic impedance of approximately 60 ohms in a transmission line having a circular center conductor extending between parallel ground planes having dimensions and a geometric relationship equivalent to the dimensions and geometric relationship of said matching post in relation to said E-plane arm, whereby the maximum power transfer without breakdown is achieved in said hybrid junction.

2. The hybrid junction of claim 1 wherein said hybrid junction is a magic tee.

3. The hybrid junction of claim 1 wherein said matching post is formed on a button base, said button base having a well surrounding said post, whereby the post length is effectively lengthened without extending the tip of the post.

4. The hybrid junction of claim 1 wherein the diameter of the matching post is determined according to the relationship:

$$Z_o' = 138 \log 10(4h/\pi D)$$

where:

$Z_o'$ = approximately 60 ohms, h = height of the waveguide forming the E-plane arm, D = diameter of the post portion of the matching button post.

5. A magic tee type hybrid junction comprising four rectangular waveguide sections forming an H-plane arm, an E-plane arm and two collinear side arms, a matching button post positioned in the junction of the magic tee for matching the H-plane arm to the input waveguide, said button post being comprised of a button portion and a post portion extending from said button portion into said E-plane arm, said post portion having a diameter selected such that the ratio of the height of the waveguide section forming the E-plane arm to the post diameter would yield a characteristic impedance of approximately 60 ohms in a transmission line having a circular center conductor extending between parallel ground planes having dimensions and a geometric relationship equivalent to the dimensions and geometric relationship of said matching post in relation to said E-plane arm, whereby the maximum power transfer without breakdown is achieved in said magic tee type hybrid junction.

6. The magic tee hybrid junction as claimed in claim 5 wherein the post diameter is determined according to the relationship:

$$Z_o' = 138 \log 10(4h/\pi D)$$

where:

$Z_o'$ = approximately 60 ohms, h = height of the waveguide forming the E-plane arm, D = diameter of the post portion of the matching button post.

7. The magic tee type hybrid junction as claimed in claim 5 wherein said button portion of the matching button post contains a well surrounding the post portion, said well having a selected depth to determine the length of the post portion while maintaining the distance between the upper tip of the post protion and a reference location on the E-plane arm constant.

8. A hybrid junction having enhanced power handling capacity comprising four waveguide sections forming an H-plane arm, an E-plane arm, two collinear side arms and a matching post extending into said E-plane arm, said hybrid junction designed using a method comprising the steps of:

selecting the diameter of the matching post according to the relationship:

$$Z_o' = 138 \log 10(4h/\pi D)$$

where:

$Z_o'$ = approximately 60 ohms, h = height of the waveguide forming the E-plane arm, D = diameter of the post portion of the matching button post.

9. The method of claim 8 further including the step of locating said matching post on a button base of the same material as the matching post and forming a well in said button base surrounding said post such that the length of the post is determined at least in part by the well depth.

* * * * *